United States Patent [19]

Maurer

[11] 4,417,921

[45] Nov. 29, 1983

[54] WELDED FERRITIC STAINLESS STEEL ARTICLE

[75] Inventor: Jack R. Maurer, Natrona Heights, Pa.

[73] Assignee: Allegheny Ludlum Steel Corporation, Pittsburgh, Pa.

[21] Appl. No.: 322,126

[22] Filed: Nov. 17, 1981

[51] Int. Cl.[3] ..... C22C 38/20

[52] U.S. Cl. ..... 75/125; 75/128 N; 75/128 G; 75/128 T; 75/126 D; 75/126 F

[58] Field of Search ..... 75/125, 128 N, 128 R, 75/128 G, 128 T, 126 D, 126 F

[56] References Cited

U.S. PATENT DOCUMENTS

| | | | |
|---|---|---|---|
| 3,607,237 | 10/1971 | Kalita | 75/124 |
| 3,607,246 | 10/1971 | Kalita | 75/124 |
| 3,650,731 | 3/1972 | Aggen | 75/125 |
| 3,850,703 | 11/1974 | Kalita | 148/12 |
| 3,953,201 | 4/1976 | Wood et al. | 75/126 |
| 4,286,986 | 9/1981 | Bourneman | 75/128 G |
| 4,331,474 | 5/1982 | Espy | 75/128 G |

OTHER PUBLICATIONS

Article: New Ferritic Stainless Steel Tube for Heat Exchangers, Deverell & Maurer, *Power Engineering* (Aug. 1980).

Publication: Stainless Steel-Allegheny Ludlum Type 439, *A-L Blue Sheet.*

*Primary Examiner*—L. Dewayne Rutledge
*Assistant Examiner*—Debbie Yee
*Attorney, Agent, or Firm*—Vincent G. Gioia

[57] ABSTRACT

A ferritic stainless steel and weldable article made therefrom is provided having good resistance to stress corrosion cracking, as well as resistance to pitting and crevice corrosion. The steel, which has good ductility and fabricability making it suitable for integrally-finned tubing, is an 11.5 to 13.5% chromium stainless steel having controlled low amounts of carbon, nitrogen, nickel and copper.

12 Claims, No Drawings

WELDED FERRITIC STAINLESS STEEL ARTICLE

BACKGROUND OF THE INVENTION

This invention relates to a weldable ferritic stainless steel having good fabrication characteristics. More particularly, the invention relates to a weldable corrosion resistant ferritic stainless steel suitable for forming integrally-finned tubular articles.

There are numerous applications for finned tubular products having increased surface area for increasing the heat transfer efficiency of the tubing for condensers, heat exchangers, evaporators, reheaters, and the like. Though aluminum, copper and plain carbon steels are frequently used for such applications, Type 304 austenitic stainless steel having nominally 18% chromium and 8% nickel has not found favorable use due to its poor resistance to stress corrosion cracking.

Though ferritic stainless steels offer desirable properties of resistance to general corrosion, as well as stress corrosion cracking, they have not become popular because of poorer mechanical properties and fabricability. Efforts have been made to improve the formability of ferritic stainless steels such as disclosed in U.S. Pat. No. 3,607,237, issued Sept. 21, 1971, and U.S. Pat. No. 3,607,246, issued Sept. 21, 1971, by limiting the carbon content and including small additions of titanium to improve formability. Such alloys are suitable for manufacturing processes including high-speed punching presses involving stamping, punching, piercing, blanking and drawing.

A ferritic stainless steel useful in moderate corrosion environments is disclosed in U.S. Pat. No. 3,850,703, issued Nov. 26, 1974, having sufficient ductility to be cold rolled direct final gauge from hot band. The steel includes aluminum to provide adequate weldability and titanium for formability. A ferritic stainless steel is disclosed in U.S. Pat. No. 3,953,201, issued Apr. 27, 1976, having good corrosion resistance, low yield strength, low tensile strength and good ductility by controlling element additions and residuals.

Recent developments in melting techniques have made it possible to produce ferritic stainless steel, such as Type 439, which has been used with beneficial results when compared to Type 304 austenitic stainless steel. Type 439 is a titanium and/or columbium stabilized ferritic stainless steel having a nominal chemistry of up to 0.07 carbon, 0.1–0.6 manganese, 0.2–0.6 silicon, 17.75–18.75 chromium, up to 0.5 nickel and up to 0.15 aluminum and the balance essentially iron with usual steel-making residuals. That steel has a lower alloying content than Type 304 and can be used to manufacture integrally-finned tubing having a good general corrosion resistance as well as good pitting and crevice corrosion resistance in chloride environments. Particularly, carbon, nitrogen and titanium are controlled such that the total carbon plus nitrogen is less than 0.04 and the titanium ranges from a minimum of 0.2 plus four times the total carbon plus nitrogen content to a maximum of 0.85%.

Though Type 439 alloy has provided some success in improved mechanical properties and fabricability for use in integrally-finned tubing in moderate to severe corrosion environments, there is still a need for a ferritic stainless steel suitable for fabrication into tubing having increased efficiencies such as are needed for MSR (Moisture Separator Reheaters) applications in power plants. Such a ferritic stainless steel alloy should be compatible with such systems and provide improved ductility to permit the fabrication of increased fin height for good to excellent heat transfer characteristics while substantially eliminating any microcracking of fins as a result of fabrication. It is desirable that the alloy be stabilized to minimize formation of carbide and nitride particles to reduce die near during forming, as well as to substantially reduce microcracking of the fins. It is also desirable that the alloy have a lower alloying content to lower the cost of manufacture of the alloy.

SUMMARY OF THE INVENTION

In accordance with the present invention, a ferritic stainless steel is provided containing controlled amounts of carbon, nitrogen, nickel and copper, stabilized with titanium and/or columbium to provide an alloy having good weldability, ductility, formability, resistance to stress corrosion cracking and one which minimizes die wear when manufactured as an integrally-finned tubing. The ferritic stainless steel consists essentially of, in weight percent, up to 0.030% carbon, up to 0.030% nitrogen, and a total carbon and nitrogen content of no more than 0.04%, from 11.5 to 13.5% chromium, up to 1% manganese, up to 1% silicon, up to 0.5% nickel, up to 0.15% copper, and a total content of nickel plus three times copper content no more than 0.80%, at least one element from the group consisting of titanium and columbium in an amount from 0.1% plus four times the total carbon and nitrogen content up to 0.75%, and the balance essentially iron with usual steel-making residuals.

A weldable ferritic stainless steel article made from that steel alloy has resistance to stress corrosion cracking, as well as resistance to pitting and crevice corrosion while having good fabricability. The ferritic stainless steel is particularly suitable for fabrication into a weldable article, such as integrally-finned tubing, by long-run, high-volume, high-speed production equipment.

DETAILED DESCRIPTION OF THE PREFERRED EMBODIMENTS

The ferritic stainless steel alloy of the present invention provides for controlling the chemistry to maintain low amounts of carbon, nitrogen, nickel and copper while stabilizing the alloy with titanium and/or columbium. The copper content may range up to 0.030%, preferably 0.010 to 0.020%. Carbon contents in excess of these amounts may result in a steel which is more difficult to weld due to the formation of martensite upon cooling of the steel which has been subjected to high temperatures for welding. The nitrogen content may range up to 0.030%, preferably 0.010 to 0.020%. Both carbon and nitrogen levels must be critically controlled to such low levels so they may be stabilized with minimal amounts of titanium and/or columbium to minimize the formation of carbide and nitride particles which adversely affect the ability of the steel to be fabricated as integrally-finned tubing. Excessive carbonitride particles can detract from the ability to fin the tubing properly, for such particles may act as notches to cause fin cracking, to restrict metal flow during forming and to lessen fin height. By reducing the formation of such particles, the steel can be fabricated into such tubing having increased fin height due to the improved ductility of the steel with such fins having minimal microcracks as a result of fabrication. The total of the carbon and nitrogen should be no more than 0.04%, preferably no more than 0.030%, so as to limit the amount of stabilizing elements necessary in the steel.

The steel alloy is stabilized with titanium and/or columbium. Preferably, at least one element from the group consisting of titanium and columbium is present in a minimal amount of 0.1 plus four times the total carbon and nitrogen content. The total amount of stabilizing element may range up to 0.75% maximum, preferably 0.60% maximum. Titanium and columbium is such amounts improve the formability of the steel, control the formation of carbide and nitride particles and avoid the development of undesirable metallurgical structures such as titanium stringers. The presence of such titanium, carbonitrides and stringers has an adverse and undesirable affect on tools and dies and appears to be responsible for excessive die wear due to the abrasiveness.

Chromium and manganese levels in the steel are limited to avoid developing unnecessary hardness and strength which would interfere with formability. Chromium content of 11.5 to 13.5% is preferred to assure the degree of corrosion resistance required for the applications to which the present invention is particularly well suited. The manganese content may range up to 1%, preferably up to 0.60%. Such manganese levels provide sufficient strength for fabrication, however, higher levels may have undesirable side effects as manganese is an austenite former.

The silicon content may range up to 1%, and preferably ranges from 0.30 to 0.60%. Silicon provides for general oxidation resistance and aids in fluidity during welding.

Nickel may be present up to 0.5%, and preferably ranges from 0.20 to 0.40%. The total amount of nickel present plus three times the copper present in the steel should be no more than 0.80%. Controlling the nickel and copper content provides for minimizing the effect of austenizing elements, reducing formation of brittle martensite and reducing the potential for stress corrosion cracking.

Copper may be present up to 0.15%, and preferably may range from 0.050 to 0.10%. Copper is desired to assure the degree of resistance to stress corrosion cracking which is required for applications such as integrally-finned tubing in moderate to severe corrosion environments. Copper contents of less than 0.05% would have no effect on the ordered properties, but would be difficult to achieve without special melting techniques and specific raw material selection.

In a preferred embodiment, the stainless steel of the present invention may have 0.01 to 0.02% carbon, 0.01 to 0.02% nitrogen and titanium stabilizer in an amount ranging from 0.1 plus four times the total carbon and nitrogen content up to 0.60%.

A still further embodiment of the steel of the present invention may have 0.01 to 0.02% carbon, 0.01 to 0.02% nitrogen and a total amount of nickel plus three times the copper of no more than 0.80%.

As an example of ferritic stainless steels of the present invention, heats A through E were melted having the following chemistry:

| HEATS | C | Mn | Cr | Ni | Cu | Ti | $N_2$ |
|---|---|---|---|---|---|---|---|
| A | .014 | .43 | 11.72 | .20 | .038 | .44 | .012 |
| B | .013 | .43 | 11.69 | .26 | .09 | .38 | .014 |
| C | .011 | .41 | 11.91 | .35 | .10 | .35 | .013 |
| D | .015 | .32 | 11.63 | .53 | .12 | .30 | .014 |

-continued

| HEATS | C | Mn | Cr | Ni | Cu | Ti | $N_2$ |
|---|---|---|---|---|---|---|---|
| E | .021 | .29 | 11.90 | .42 | .11 | .20 | .022 |

The Table illustrates heats A, B and C as falling within the scope of the present invention. Heat D is not an alloy of the present invention because the nickel content is excessive and the total amount of nickel plus three times the copper is excessive. Also, heat E is outside the present invention for the total carbon and nitrogen content exceeds the upper limit of 0.04%.

Heats A through C can be melted and fabricated into integrally-finned tubing using conventional techniques. The ferritic stainless steel of the present invention and the tubing article made therefrom can provide substantial resistance to stress corrosion cracking. The product is capable of service in the as-welded condition suitable for subsequent operations such as cold forming, annealing, pickling or any combination of such operations without adversely affecting the corrosion resistant properties.

Furthermore, the material of heats A, B and C can be fabricated into integrally-finned tubing having increased fin height with minimal microcracking of fins and without excessive finning die wear. The steel is suitable for integrally-finned tubing of different sizes, such as 0.625 inch (1.588 cm) outside diameter having 0.049 inch (0.124 cm) wall thickness, 18 BWG (Birmingham Wire Gage); 0.75 inch (1.905 cm) outside diameter having 0.065 inch (0.165 cm) wall thickness, 16 BWG; and 1 inch (2.54 cm) outside diameter having 0.083 inch (0.211 cm) wall thickness, 14 BWG.

While several embodiments of the invention have been shown and described, it will be apparent to those skilled in the art that modifications may be made therein without departing from the scope of the present invention.

What is claimed is:

1. A ferritic stainless steel consisting essentially of, in weight percent, up to 0.03% carbon, up to 0.03% nitrogen, and a total amount of carbon and nitrogen content of no more than 0.04%, from 11.50 to 13.50% chromium, up to 1.0% manganese, up to 1.0% silicon, up to 0.5% nickel, up to 0.15% copper, and a total amount of nickel and three times the copper of no more than 0.80%, at least one element from the group consisting of titanium and columbium in an amount from 0.1 and four times the total carbon and nitrogen up to 0.75%, and the balance essentially iron with usual steelmaking residuals, said steel characterized by low amounts of carbon, nitrogen, and copper for providing good fabricability suitable for integrally-finned tubing.

2. A ferritic stainless steel as set forth in claim 1 having up to 0.6% manganese.

3. A ferritic stainless steel as set forth in claim 1 having 0.30 to 0.60% silicon.

4. A ferritic stainless steel as set forth in claim 1 having 0.01 to 0.02 carbon, 0.01 to 0.02% nitrogen and at least one element from the group consisting of titanium and columbium in an amount from 0.1 and four times the total carbon and nitrogen up to 0.60%.

5. A ferritic stainless steel as set forth in claim 1 having 0.01 to 0.02% carbon, 0.01 to 0.02% nitrogen and a total amount of nickel and three times copper of no more than 0.80%.

6. A weldable ferritic stainless steel article resistant to stress corrosion cracking and resistant to pitting and crevice corrosion in steam environments and having good fabricability, said steel consisting essentially of, in weight percent, up to 0.03% carbon, up to 0.03% nitrogen, and a total amount of carbon and nitrogen content of no more than 0.04%, from 11.50 to 13.50% chromium, up to 1.0% manganese, up to 1.0% silicon, up to 0.5% nickel, up to 0.15% copper, and a total amount of nickel and three times the copper of no more than 0.80%, at least one element from the group consisting of titanium and columbium in an amount from 0.1 and four times the total carbon and nitrogen up to 0.75%, and the balance essentially iron with usual steelmaking residuals, said steel characterized by low amounts of carbon, nitrogen, nickel and copper for providing good fabricability suitable for integrally-finned tubing.

7. A weldable ferritic stainless steel article as set forth in claim 6, wherein the article is tubing.

8. A weldable ferritic stainless steel article as set forth in claim 6 having up to 0.6% manganese.

9. A weldable ferritic stainless steel article as set forth in claim 6 having 0.30 to 0.60% silicon.

10. A weldable ferritic stainless steel article as set forth in claim 6 having 0.01 to 0.02% carbon, 0.01 to 0.02% nitrogen and at least one element from the group consisting of titanium and columbium in an amount from 0.1 and four times the total carbon and nitrogen up to 0.60%.

11. A weldable ferritic stainless steel article as set forth in claim 6 having 0.01 to 0.02% carbon, 0.01 to 0.02% nitrogen and a total amount of nickel and three times copper of no more than 0.80%.

12. A process for producing a weldable ferritic stainless steel comprising the steps of: preparing a melt consisting essentially of, in weight percent, up to 0.03% carbon, up to 0.03% nitrogen, and a total amount of carbon and nitrogen content of no more than 0.04%, from 11.50 to 13.50% chromium, up to 1.0% manganese, up to 1.0% silicon, up to 0.5% nickel, up to 0.15% copper, and a total amount of nickel and three times the copper of no more than 0.80%, at least one element from the group consisting of titanium and columbium in an amount from 0.1 and four times the total carbon and nitrogen up to 0.75%, and the balance essentially iron with usual steelmaking residuals and casting the steel, and controlling carbon, nitrogen, nickel and copper to low amounts for providing a stabilized low alloyed steel having good fabricability suitable for integrally-finned tubing.

* * * * *